US005311202A

United States Patent [19]

Popp et al.

[11] Patent Number: 5,311,202

[45] Date of Patent: May 10, 1994

[54] FREQUENCY-SELECTIVE SURFACE STRUCTURE HAVING H-SHAPED SLOTS

[75] Inventors: Reinhard Popp, Bad Aibling; Lothar Heichele, Otterfing, both of Fed. Rep. of Germany

[73] Assignee: Messerschmitt-Bolkow-Blohm GmbH, Fed. Rep. of Germany

[21] Appl. No.: 892,318

[22] Filed: Jun. 3, 1992

[30] Foreign Application Priority Data

Jun. 27, 1991 [DE] Fed. Rep. of Germany ..... 4121245

[51] Int. Cl.[5] ..... H01Q 15/00

[52] U.S. Cl. ..... 343/909

[58] Field of Search ..... 343/909, 754–756, 343/767, 769, 872

[56] References Cited

U.S. PATENT DOCUMENTS 2,820,220 1/1958 Charman ..... 343/767 X
3,769,623 10/1973 Fletcher et al. ..... 343/909
4,126,866 11/1978 Pelton ..... 343/909
4,287,520 9/1981 Van Vliet et al. ..... 343/909
4,785,310 11/1988 Rosen ..... 343/909

FOREIGN PATENT DOCUMENTS 2349968 11/1977 France ..... 343/909

*Primary Examiner*—Benny T. Lee
*Attorney, Agent, or Firm*—Evenson, McKeown, Edwards & Lenahan

[57] ABSTRACT

A frequency-selective surface structure for narrow-band filtering of electromagnetic waves, comprising a fully wave-reflective surface perforated by H-shaped slot elements each consisting of end limiting bars and a connecting bar extending transversely with respect to the limiting bars. The end limiting bars of the individual slot elements each have essentially the same length as the connecting bar and have a bar length of approximately one fourth of the operating wave length.

19 Claims, 2 Drawing Sheets

FREQUENCY-SELECTIVE SURFACE STRUCTURE HAVING H-SHAPED SLOTS

BACKGROUND AND SUMMARY OF THE INVENTION

This invention relates to a frequency-selective surface structure for filtering electromagnetic waves.

For such frequency-selective surface structures which have a fully reflective surface penetrated by slot elements in a repetitive pattern, slot configurations in numerous embodiments are known from the state of the art, starting with simple longitudinal or transverse slots (U.S. Pat. No. 4,314,255), continuing with Jerusalem cross slots and H-shaped slot elements (German Patent Document DE-OS 3 726 309) and ranging to geometrically complex tripolar or multipolar slot elements (U.S. Pat. Nos. 3,975,738 and 4,126,866). However, none of the known slot elements meets the requirement for qualitatively high-value band pass characteristics to an unlimited extent. Either the resulting surface structure has a filter action that is too broad-banded or has excessive transmission losses and/or the resonance frequency is highly dependent on the wave angle or on the polarization.

It is an object of the present invention to provide a frequency-selective surface structure provided with a slot pattern in the case of which a narrow-band filter action with low transmission losses can be achieved that is largely independent of the wave angle and of the polarization.

This object is achieved according to the invention by means of the special geometrical design of an H-shaped slot structure to keep the mutual distance from center to center of the slot elements (and thus the transmission losses and the dependence on the wave angle) very small, without resulting in interfering coupling effects between the individual slot elements, which adversely affect the narrow-band resonance behavior of the surface structure. In addition, the slot elements according to the invention, because of their orthogonal-symmetrical surface geometry which has essentially the same length in the X-direction and in the Y-direction, which for the purpose of polarization-independent band-pass characteristics, can easily be arranged in a slot pattern that is identical in the H-plane and in the E-plane.

In a first preferred embodiment, the polarization-independent filter action is achieved by arranging adjacent slot elements at right angles with respect to one another in each case.

In order to further improve the degree of transmission and stability with respect to wave angle changes by a slot density of the surface structure that is as high as possible without any adversely affecting on the filter band width, the slot elements in a second preferred embodiment, are each positioned with a center distance in both the horizontal and vertical directions of approximately a third of a wave length of the wave frequency to be selected.

The slot width of the individual slot elements is selected according to the desired filter band width and, with a view to a narrow-band filter action, preferably amounts to approximately 1% of the operating wave length in the area of the connecting bars, while the limiting bars are approximately half as wide as the connecting bars.

Another embodiment of the invention, which is particularly preferred because of a high edge steepness of the filter, consists of the fact that the surface structure is constructed as a sandwich component, with two outer cover layers, each penetrated by H-shaped slot elements and an intermediate layer arranged between them which is constructed of a low-loss dielectric, having an effective electrical layer thickness which corresponds to one fourth of the operating wave length. With a view to a favorable transmission action, it was found to be expedient to arrange the H-shaped slot elements in alignment with one another in the two outer cover layers.

Other objects, advantages and novel features of the present invention will become apparent from the following detailed description of the invention when considered in conjunction with the accompanying drawings.

DETAILED DESCRIPTION OF THE DRAWINGS

Figure 1:
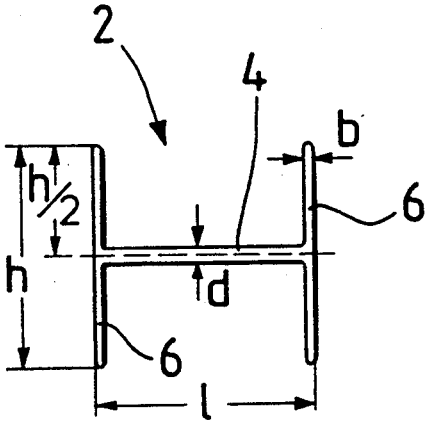
FIG. 1 is a schematic representation of the slot configuration of an individual H-shaped slot element.

FIG. 1 illustrates an H-shaped slot element 2 comprising a connecting bar 4 and two limiting bars 6 which connect at a right angle to opposite ends of the connecting bar 4. The length 1 of the connecting bar 4 (as shown in FIGS. 1 and 2) is equal to the length h of each transverse bar 6 (as shown in FIG. 1 and 2), and corresponds to one fourth of the operating wave length λ; since limiting bars 6 are connected to the connecting bar 4 (as shown in FIGS. 1 and 2) approximately at their respective mid points (h/2), the slot element 2 has an orthogonal-symmetrical slot configuration.

The slot width d of the connecting bar 4 is selected according to the desired filter band width and, with a view to a narrow-band filter action, amounts to approximately 1% of the operating wave length λ. The width b of the limiting bars 6 is approximately half this size.

Figure 2:
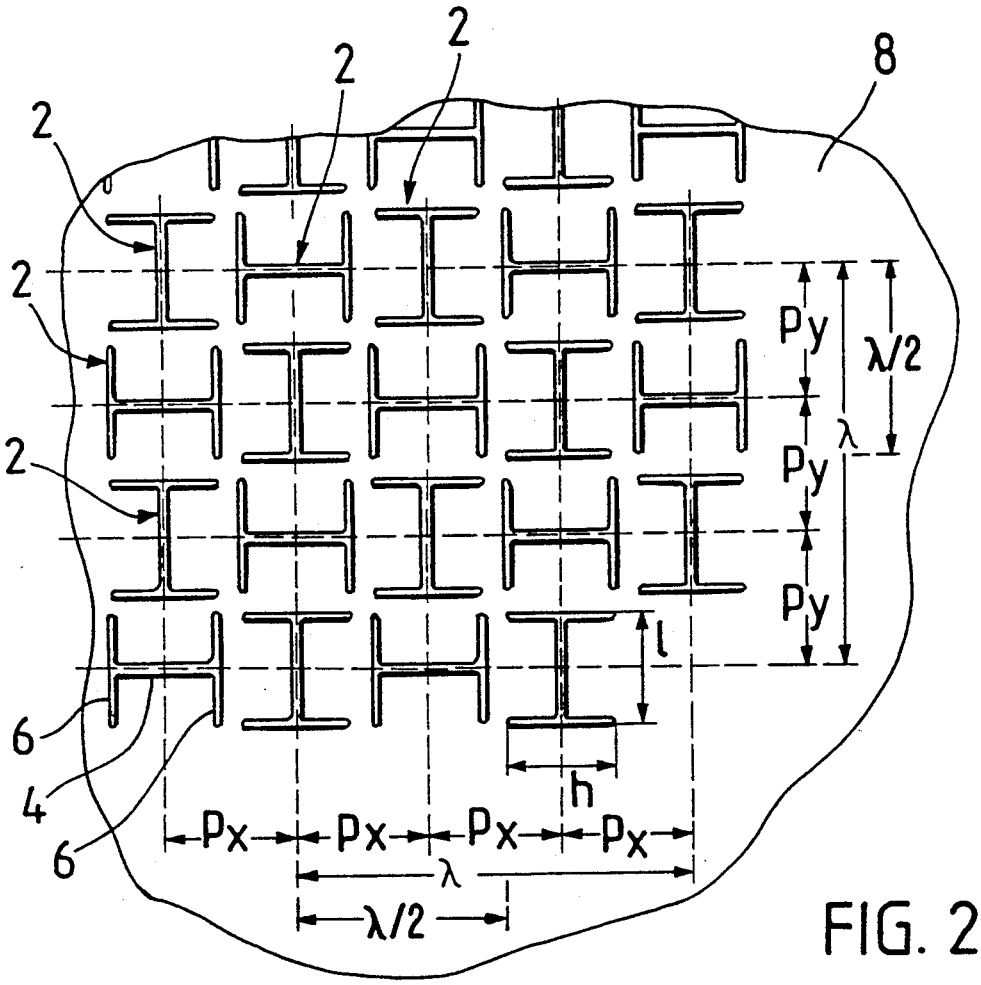
FIG. 2 is a schematic representation of a cutout of a frequency-selective surface structure with a periodic arrangement of H-shaped slot elements according to FIG. 1.

FIG. 2 shows a frequency-selective surface structure 8, the surface of which consists of a thin metallic layer whose thickness is much smaller than the operating wave length λ of the filter. The surface is penetrated by a periodically repetitive pattern of H-shaped slot elements 2, horizontally and vertically adjacent slot elements 2 being rotated by 90° relative to one another in each case. The center distances, $p_x$ in the horizontal direction and $p_y$ in the vertical direction, have the same measurements. As a result, identical polarization characteristics are obtained in the orthogonal directions.

In order to minimize the dependence of the filter characteristics on the wave angle and the transmission losses, the mutual center distance and the surface requirement of the slot elements 2 must be kept small, without resulting in any disturbing coupling effects between the individual slot elements 2. By means of the described slot geometry, this is achieved by the fact that the center distances $p_x$ and $p_y$ amount to approximately one third of the operating wave length λ; that is, on a square incremental area of the surface structure 8 with an edge length λ, approximately nine slot elements 2 can be accommodated, and the mutual center distances $p_x$ and $p_y$ of the slot elements 2 is much smaller than half the operating wave length λ/2, as shown in FIG. 2.

Figure 3:
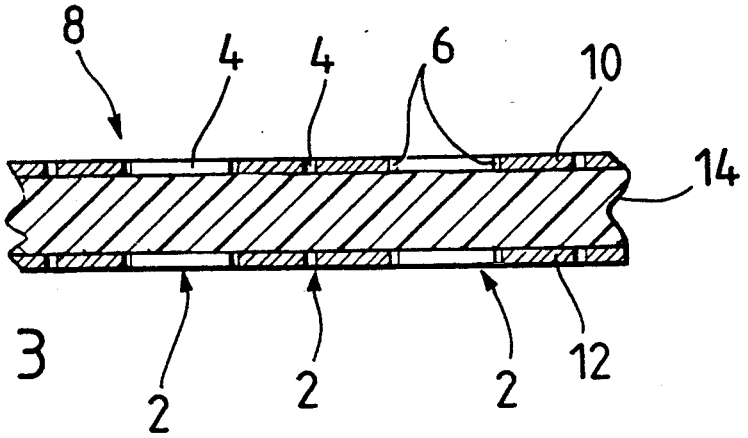
FIG. 3 is a schematic representation of a sectional view of the surface structure according to FIG. 2 in a sandwich construction.

FIG. 3 illustrates the sandwich construction of the surface structure 8. The metallic cover layers 10, 12 are perforated by H-shaped slot patterns having transverse bars 6 and connecting bars 4, which correspond to the bars 4 and 6 in FIGS. 1 and 2) in the arrangement illustrated in FIG. 2, with the slot elements 2 in the upper and the lower cover layer 10, 12 being aligned with one another and are held at a distance from one another by an intermediate layer 14 made of a low-loss dielectric, having an effective electric layer thickness which corresponds to one fourth of the operating wave length λ. A greater edge steepness of the filter is achieved by means of such a sandwich construction.

Figure 4:
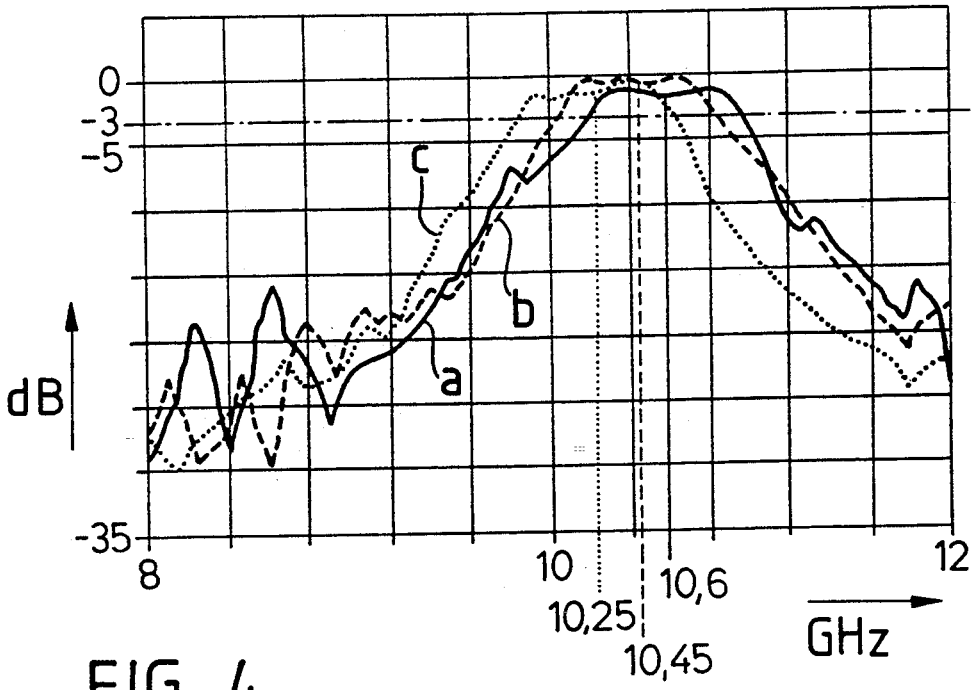
FIG. 4 is a schematic representation of the transmission curves of the surface structure for different wave angles.

FIG. 4 illustrates the transmission curves for different wave angles measured by means of a test pattern, curve a corresponding to a wave angle of 0° (vertical wave); curve b corresponding to a wave angle of 20°; and curve c corresponding to a wave angle of 40°. As shown, the center frequency of the surface structure changes only slightly with an increasing wave angle, specifically from 10.6 GHz at 0° to 10.25 GHz at 40°. The 3-dB band width is also constantly low, and in the whole wave angle range amounts to less 800 MHz. Furthermore, it is illustrated that the transmission losses in the resonance range of the surface structure independently of the wave angle, are almost at zero, and that the surface structure has a high selectivity because of the high edge steepness of the transmission curves.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A frequency-selective surface structure for the narrow-band filtering of electromagnetic waves, comprising a fully wave-reflective surface perforated by H-shaped slot elements, each H-shaped slot element being defined by parallel end limiting slots and a connecting slot extending transversely to and connected with the limiting slots, wherein each of the end limit slots of the slot elements has a length substantially equal to a length of the corresponding connecting slot, each said length being approximately one fourth of a wave length of a desired operating frequency.

2. A surface structure according to claim 1, wherein said slot elements are arranged in an array of adjacent slot elements, with each such slot element being oriented substantially at a right angle relative to slot elements adjacent thereto.

3. A surface structure according to claim 2, wherein said frequency selective surface comprises adjacent layers, including two outer cover layers defining said fully wave reflective surface, with each outer cover layer being perforated by said H-shaped slot elements, and an intermediate layer arranged between said outer cover layers, said intermediate layer comprising a low-loss dielectric material and having an electric layer thickness which corresponds to one fourth of said wave length.

4. A surface structure according to claim 2, wherein the slot elements are separated from each other in said array by a respective center distance of approximately one third of a wave length of a desired operating frequency.

5. A surface structure according to claim 4, wherein each of the connecting bars has a slot width that is twice as large as a slot width of the corresponding limiting bars.

6. A surface structure according to claim 5, wherein said frequency selective surface comprises adjacent layers, including two outer cover layers defining said fully wave reflective surface, with each outer cover layer being perforated by said H-shaped slot elements, and an intermediate layer arranged between said outer cover layers, said intermediate layer comprising a low-loss dielectric material and having an electric layer thickness which corresponds to one fourth of said wave length.

7. A surface structure according to claim 6, wherein the H-shaped slot elements are aligned in registration with one another in the two outer cover layers.

8. A surface structure according to claim 4, wherein said frequency selective surface comprises adjacent layers, including two outer cover layers defining said fully wave reflective surface, with each outer cover layer being perforated by said H-shaped slot elements, and an intermediate layer arranged between said outer cover layers, said intermediate layer comprising a low-loss dielectric material and having an electric layer thickness which corresponds to one fourth of said wave length.

9. A surface structure according to claim 2, wherein each of the connecting bars has a slot width that is twice as large as a slot width of the corresponding limiting bars.

10. A surface structure according to claim 9, wherein said frequency selective surface comprises adjacent layers, including two outer cover layers defining said fully wave reflective surface, with each outer cover layer being perforated by said H-shaped slot elements, and an intermediate layer arranged between said outer cover layers, said intermediate layer comprising a low-loss dielectric material and having an electric layer thickness which corresponds to one fourth of said wave length.

11. A surface structure according to claim 1, wherein each of the connecting bars has a slot width that is twice as large as a slot width of the corresponding limiting bars.

12. A surface structure according to claim 11, wherein said frequency selective surface comprises adjacent layers, including two outer cover layers defining said fully wave reflective surface, with each outer cover layer being perforated by said H-shaped slot elements, and an intermediate layer arranged between said outer cover layers, said intermediate layer comprising a low-loss dielectric material and having an electric layer thickness which corresponds to one fourth of said wave length.

13. A surface structure according to claim 1, wherein the slot elements are separated from each other in said array by a respective center distance of approximately one third of a wave length of a desired operating frequency.

14. A surface structure according to claim 13, wherein each of the connecting bars has a slot width that is twice as large as a slot width of the corresponding limiting bars.

15. A surface structure according to claim 14, wherein said frequency selective surface comprises adjacent layers, including two outer cover layers defining said fully wave reflective surface, with each outer cover layer being perforated by said H-shaped slot elements, and an intermediate layer arranged between said outer cover layers, said intermediate layer comprising a low-loss dielectric material and having an electric layer thickness which corresponds to one fourth of said wave length.

16. A surface structure according to claim 13, wherein said frequency selective surface comprises adjacent layers, including two outer cover layers defining said fully wave reflective surface, with each outer cover layer being perforated by said H-shaped slot elements, and an intermediate layer arranged between said outer cover layers, said intermediate layer comprising a low-loss dielectric material and having an electric layer thickness which corresponds to one fourth of said wave length.

17. A surface structure according to claim 1, wherein said frequency selective surface comprises adjacent layers, including two outer cover layers defining said fully wave reflective surface, with each outer cover layer being perforated by said H-shaped slot elements, and an intermediate layer arranged between said outer cover layers, said intermediate layer comprising a low-loss dielectric material and having an electric layer thickness which corresponds to one fourth of said wave length.

18. A surface structure according to claim 17, wherein the H-shaped slot elements are aligned in registration with one another in the two outer cover layers.

19. A surface structure according to claim 17, wherein said outer cover layers are comprised of a conductive material.

* * * * *